US006315291B1

(12) United States Patent
Moody

(10) Patent No.: US 6,315,291 B1
(45) Date of Patent: Nov. 13, 2001

(54) MULTIPLE PLAY KENO GAMES

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 09/439,755

(22) Filed: Nov. 15, 1999

Related U.S. Application Data

(63) Continuation-in-part of application No. 09/244,601, filed on Feb. 4, 1999, now abandoned, and a continuation-in-part of application No. 09/175,226, filed on Oct. 20, 1998, now Pat. No. 6,098,985, and a continuation-in-part of application No. 09/083,531, filed on May 22, 1998, now Pat. No. 6,007,066, and a continuation-in-part of application No. 08/900,965, filed on Nov. 25, 1997, now Pat. No. 5,823,873, and a continuation-in-part of application No. 08/755,174, filed on Nov. 25, 1996, now Pat. No. 5,732,950, and a continuation-in-part of application No. 08/495,952, filed on Jun. 28, 1995, now Pat. No. 5,531,448.

(60) Provisional application No. 60/019,879, filed on Jun. 17, 1996.

(51) Int. Cl.[7] ..... A63F 3/06

(52) U.S. Cl. ..... 273/139; 273/269; 283/903; 463/18

(58) Field of Search ..... 273/269, 139; 283/903; 463/17–19

(56) References Cited

U.S. PATENT DOCUMENTS

| | | | | |
|---|---|---|---|---|
| 2,228,180 | * | 1/1941 | Pauli | 273/139 |
| 2,474,573 | * | 6/1949 | Cohen | 273/139 |
| 3,589,729 | * | 6/1971 | Girard | 273/269 |
| 5,303,929 | * | 4/1994 | Sandeen | 273/269 |
| 5,909,875 | * | 6/1999 | Weingardt | 273/269 |
| 6,079,710 | * | 6/2000 | Brown | 273/269 |

OTHER PUBLICATIONS

Scarne's New Complete Guide to Gambling, John Scarne, pp. 490–499, coypright 1974.

* cited by examiner

*Primary Examiner*—Benjamin H. Layno
(74) *Attorney, Agent, or Firm*—John Edwards Roethel

(57) ABSTRACT

The invention allows two, three or more keno games to be played on the same keno ticket while at the same time allowing the results of the keno games to be blended together to provide new winning keno combinations to be available to the player. A keno ticket is provided with two or more, and preferably three, sections for each possible numbered spot. The player selects one or more numbered spots on the keno ticket. Twenty numbers are drawn corresponding to the first section of the keno ticket. Then the keno balls are re-mixed and another twenty numbers are drawn corresponding to the second section of the keno ticket. If more than two sections are provided on each keno ticket, the step of re-mixing the keno balls and drawing another twenty numbers corresponding to each additional section of the keno ticket is repeated. Each section game is treated separately to determine whether the player has a winning ticket. Another determination is made as to whether the player has winning combinations on each individual numbered spot depending on which section of each numbered spot has matching drawn numbers. The player, alternatively, may also select one or more of the sections of each numbered spot so that the player may play different groups of number spots over the course of consecutive draws of keno numbers.

25 Claims, 9 Drawing Sheets

MULTIPLE PLAY KENO GAMES

CROSS-REFERENCE TO RELATED APPLICATIONS

This application is a Continuation-in-Part of application Ser. No. 08/495,952, entitled "Poker-Style Card Game", filed Jun. 28, 1995, now U.S. Pat. No. 5,531,448; and is also based on and is a Continuation-in-Part of Provisional Application Ser. No. 60/019,879, entitled "Electronic Video Poker Games", filed Jun. 17, 1996; and is also a Continuation-in-Part of application Ser. No. 08/755,174, entitled "Electronic Video Poker Games", filed Nov. 25, 1996, now U.S. Pat. No. 5,732,950; and is also a Continuation-in-Part of application Ser. No. 08/900,965, entitled "Electronic Video Poker Games", filed Nov. 25, 1997, now U.S. Pat. No. 5,823,873; and is also a Continuation-in-Part of application Ser. No. 09/083,531, entitled "Electronic Video Poker Games", filed May 22, 1998, U.S. Pat. No. 6,007,066 and is also a Continuation-in-Part of application Ser. No. 09/175,226, filed Oct. 20, 1998, entitled "Electronic Video Poker Games", now U.S. Pat. No. 6,098,985 and is also a Continuation-in-Part of application Ser. No. 09/244,601, filed Feb. 4, 1999, entitled "Multiple Play Keno Games", now abandoned.

BACKGROUND OF THE INVENTION

This invention relates primarily to live or electronic video keno games, and more particularly to live or electronic video keno games that allow the player to play his keno ticket multiple times on the same round of the game.

Keno is a well known game and has been played in gaming establishments for many years. In conventional keno, there are eighty numbers in the pool of numbers that may be drawn in any one round of the game. In the typical keno game, eighty keno balls are numbered 1 through 80 and are placed in a air blower device that circulates the keno balls. Twenty of the eighty keno balls are selected each game.

Each player marks a keno ticket that is an 10×8 matrix having ten columns and eight rows. The keno numbers from one through eighty are printed on the keno ticket with each number having its own numbered spot. Prior to the start of a round of the keno game, a player selects between one and fifteen numbered spots that the player thinks will be drawn during the game. Typically a player uses a crayon-like pencil to mark the numbered spots he wishes to play on his keno ticket and the player takes his marked keno ticket to a keno station. The player makes an appropriate wager and turns in his marked keno ticket and the money at the keno station. The player receives back a stamped and receipted ticket showing the amount of the player's wager and the numbered spots that the player has selected.

The keno game operator then proceeds to draw twenty numbers from the eighty keno balls. Depending on the number of matches or "Hits" between the twenty numbers drawn and the numbered spots selected by the player, the player wins or loses. The more numbers that match, the higher the payoff to the player. In keno, unlike in bingo which is a related number drawing game, there is no requirement that the numbers that are drawn must appear in certain patterns on the keno ticket. However in keno, also unlike bingo in which numbers are drawn until a winner occurs, only twenty numbers are drawn in each round of a keno game so there is no guarantee that any player will win during each round of the keno game. But there can also be multiple winners in any round of the keno game.

In a live keno game, multiple players participate each game and no players may win, some players may win or all players may win. In traditional live keno, players may select between one and fifteen numbers and wagers can range from as little as 35¢ a game to $5, $10 or even higher dollars per game. Typically each establishment operating a keno game will provide a group of keno payout charts or keno pay tables showing the amount that it is possible for the player to win based on the amount wagered, the number of numbered spots selected by the player and the number of "Hits" achieved by the player when the twenty keno balls are selected.

For example, if the player wagers $1 and selects one number, the player will typically win $3 if his selected numbered spot is one of the twenty numbered keno balls drawn during the play of the game. Similarly, if the player selects fifteen numbers, the player will typically be paid if anywhere between a total of eight and fifteen of his numbered spots match the twenty numbered keno balls drawn. The highest payout will be made for matching fifteen out of fifteen, with lower payouts made for matching fourteen out of fifteen, thirteen out of fifteen and so on down to eight out of fifteen. Any matches of seven or less are typically losing plays. Similar payout schemes are provided when the player marks between one and fifteen numbered spots during any round of a keno game.

When the player plays an electronic video keno gaming machine, a single player plays against the keno gaming machine for each round of the game and the player either wins or loses each round. The player wagers one or more coins, tokens or credits and selects the number of numbered spots that the player is attempting to match during that round of the game.

All eighty numbers are displayed on a video screen with a 10×8 matrix keno display similar to that of a keno ticket. The numbers are selected by the player using by a light pen, or by pressing the numbers on a selection panel or by touching the numbers selected using conventional touch screen technology.

In the typical electronic keno format, the player may select between one and ten numbered spots to attempt to match. After the player has completed selecting the numbered spots that the player wishes to match and has made the appropriate wager, the player presses the "Start" button. This causes the electronic controls of the gaming machine to randomly select twenty numbers from the pool of eighty numbers and the selected numbers are displayed to the player. The electronic controls of the gaming machine determine whether the player has achieved a winning payout at the conclusion of each round of the game. Just as in live keno, the player wins when he matches all or a predetermined minimum number of his selected numbered spots. If the player matches less than the predetermined minimum number of his selected numbered spots, then the player loses his wager. Payouts are made by accruing credits on the credit meter of the gaming machine or dispensing coins or tokens into a payout tray.

One variation of keno that is available on certain electronic keno gaming machines is what is known as "FOUR CARD" keno. In this variation, the player is presented with four keno ticket displays: an "A" game, a "B" game, a "C" game and a "D" game. The player may wager the same or different amounts on each game up to the maximum amount allowed by the gaming machine, say one to four credits on each game. The player then selects the quantity of numbered spots to be played on each game and the player marks the particular numbered spots which the player wishes to play in each game. The player can mark the same numbered spots or different numbered spots or overlapping numbered spots in each of the "A" game, the "B" game, the "C" game and the "D" game. One group of twenty keno balls are drawn applicable to all four games and winning and losing plays are determined.

One well known variation of keno is the use of what is known as a "way" ticket. "Way" tickets can be played in live keno games and some electronic video keno gaming machines have been configured to allow preselected "way" tickets to be played. On a "way" ticket, a player selects groups of numbered spots to be played simultaneously on the same ticket for a particular game of keno.

For example, the player marks group A of three numbered spots, group B of three numbered spots and group C of three numbered spots. If the player then designates the keno ticket as a "seven-way" ticket, the player has made seven separate wagers on this single ticket: wager 1 is a three-spot wager of the numbered spots in group A, wager 2 is a three-spot wager of the numbered spots in group B, wager 3 is a three-spot wager of the numbered spots in group C, wager 4 is a six-spot wager of the numbered spots in groups A and B, wager 5 is a six-spot wager of the numbered spots in groups A and C, wager 6 is a six-spot wager of the numbered spots in groups B and C and wager 7 is a nine-spot wager of the numbered spots in groups A, B and C. The total amount wagered by the player on this "way" ticket is allocated one-seventh to each wager. A single group of twenty keno numbers is drawn and winning and losing wagers are determined. This "seven-way" ticket can be played in a live keno game and is also one of the preselected "way" tickets that is available on certain electronic video keno gaming machines.

The variations of "way" tickets are innumerable. For example, a player can play a "three-way" ticket of a five-spot, a six-spot and a seven-spot for a total of three wagers. The five "A" spots form the five-spot wager, a "B" spot combines with the five "A" spots to form the six-spot ticket and a "C" spot combines with the five "A" spots and the "B" spot to form a seven-spot ticket. Again, a single group of twenty keno numbers is drawn and winning and losing wagers are determined. This "three-way" ticket can be played in a live keno game and is also one of the preselected "way" tickets that is available on certain electronic video keno gaming machines.

The only limitation on the number of "ways" that a player may create on a keno ticket is the imagination and creativity of the player as well as the player's bankroll. Once a player has marked his keno ticket and selected the various numbered spot groupings that form the various "ways" that the player wishes to play, a single draw of keno numbers is made for that play of the game and winning and losing wagers are determined. Each "way" on a "way" ticker requires the player to make a separate wager.

The basic principles of the play of keno are set out in Scarne's New Complete Guide to Gambling, by John Scarne, at pages 490–499.

Many gaming establishments offer a series of multiple keno games in which the player marks a single keno ticket with his selected numbers and plays the same numbers over a consecutive series of games. For example, the player can wager $100.00 for one hundred consecutive keno games. Each individual game carries a wager of $1.00 and the player plays the same numbers for one hundred consecutive games. The results of these one hundred games are accrued by the gaming establishment, normally using a computer memory, and the player is paid any accumulated payouts at the end of the one hundred games. These consecutive multiple games go by various names, such as race horse keno, at various casinos.

None of these prior methods of keno have considered allowing the player to divide the numbered spots on the keno ticket into sections. If the numbered spots on the keno ticket were divided into sections, then the player could play two or more keno games consecutively and the player could be provided with additional payouts for having the various sections of each selected numbered spot on the keno ticket being drawn in multiple draws of the selected keno numbers. In addition to the conventional keno payouts, the player could be paid additional payouts for matching two, three or more sections of selected numbered spots over the course of multiple draws.

The use of multiple sections on each numbered spot would also allow the player to play different groups of numbered spots on the same keno ticket over the course of multiple draws. A disadvantage of conventional Keno is that the pace of the game can be quite slow and, by providing for multiple draws of the selected keno numbers to be played on the same keno ticket, the revenue generated by keno can be increased. Player appeal can also be improved by providing the additional payouts for matching two, three or more section of each numbered spot over the course of multiple games.

It is an object of the present invention to provide an improved keno ticket and an improved keno game that allows multiple plays on the same keno ticket with an increase in revenue to the gaming establishment and an increase in game appeal to the player.

It is a feature of the present invention to provide a keno ticket with each numbered spot being divided into two, three or more sections. This allows the player to select one or more numbered spots and to receive additional payouts if two, three or more sections of the selected numbered spots are drawn over the course of multiple games. This also allows the player, alternatively, to select only certain sections of each numbered spot so that the player can play different numbered spots on the same keno ticker over the course of multiple draws of the selected keno numbers.

It is an advantage of the present invention that the play of keno will be speeded up thus increasing the revenue to the gaming establishment and that additional payout opportunities will be provided to the player thus improving the appeal of the game to the player.

Other objects, features and advantages of the present invention will become apparent from a consideration of the following detailed description.

SUMMARY OF THE INVENTION

A method and apparatus is provided to allow two or more, and preferably three, keno games to be played on the same keno ticket while at the same time allowing the results of the two or more, and preferably three, keno games to be blended together to provide new winning keno combinations to be available to the player. A keno ticket is provided with two or more, and preferably three, sections for each possible numbered spot. The player selects one or more numbered spots on the keno ticket.

When the numbers are drawn, a first twenty numbers are drawn corresponding to the first section of the keno ticket from a complete pool of eighty numbers. Then the keno balls are re-mixed, and another twenty numbers are drawn corresponding to the second section of the keno ticket from a complete pool of eighty numbers. If more than two sections are provided on each keno ticket, the step of re-mixing the keno balls and drawing another twenty numbers corresponding to each additional section of the keno ticket from a complete pool of eighty numbers is repeated.

Initially, each section game with its own draw of selected keno numbers is treated separately to determine whether the player has a winning ticket. After winning and losing tickets have been determined for each section, another determination is made as to whether the player has winning combinations on each individual numbered spot depending on which section of each numbered spot has matching drawn numbers.

The player, alternatively, may also select one or more of the sections of each numbered spot so that the player may play different groups of number spots over the course of consecutive keno games.

DETAILED DESCRIPTION OF THE PREFERRED EMBODIMENTS

The method of the present invention is played using either a live keno game format or using an electronic keno gaming machine. The description that follows refers to an electronic keno gaming machine, but the same principles of the present invention can be easily adapted to a live keno game format. In electronic keno gaming machines, the player makes his selection of numbered spots on a keno ticket display or keno display whereas in live keno games the player makes his selection of numbered spots on a paper keno ticket. As used herein in this description and the accompanying claims, the terms "keno ticket display", "keno display" and "keno ticket" are intended to be equivalent.

An electronic keno gaming machine is provided with a video screen display, a coin head for receiving coins or gaming tokens, a bill acceptor for receiving paper currency, a coin hopper for making payouts into a payout tray, one or more payout tables which can be displayed on the gaming glass or on the video screen display and computer controls to operate the gaming machine. Also provided are various buttons that allow the player to make wagers, start the play of the game and collect winnings. Each of these elements are conventional in electronic keno gaming machines.

The method and apparatus of the present invention allows two or more, and preferably three, keno games to be played on the same keno video screen display or using a single paper keno ticket or its equivalent in a live keno game.

The video screen display shows a 10×8 matrix of the eighty numbers which represents the keno ticket to be marked by the player. The player selects the numbered spots by using a light pen or touch screen technology or any suitable manner of allowing the player to make his selection.

Each numbered spot on the matrix shown on the screen display is divided into multiple sections. In the preferred embodiment of the present invention, each numbered spot is divided into three sections, although only two sections or four or more sections can be used.

Figure 1:
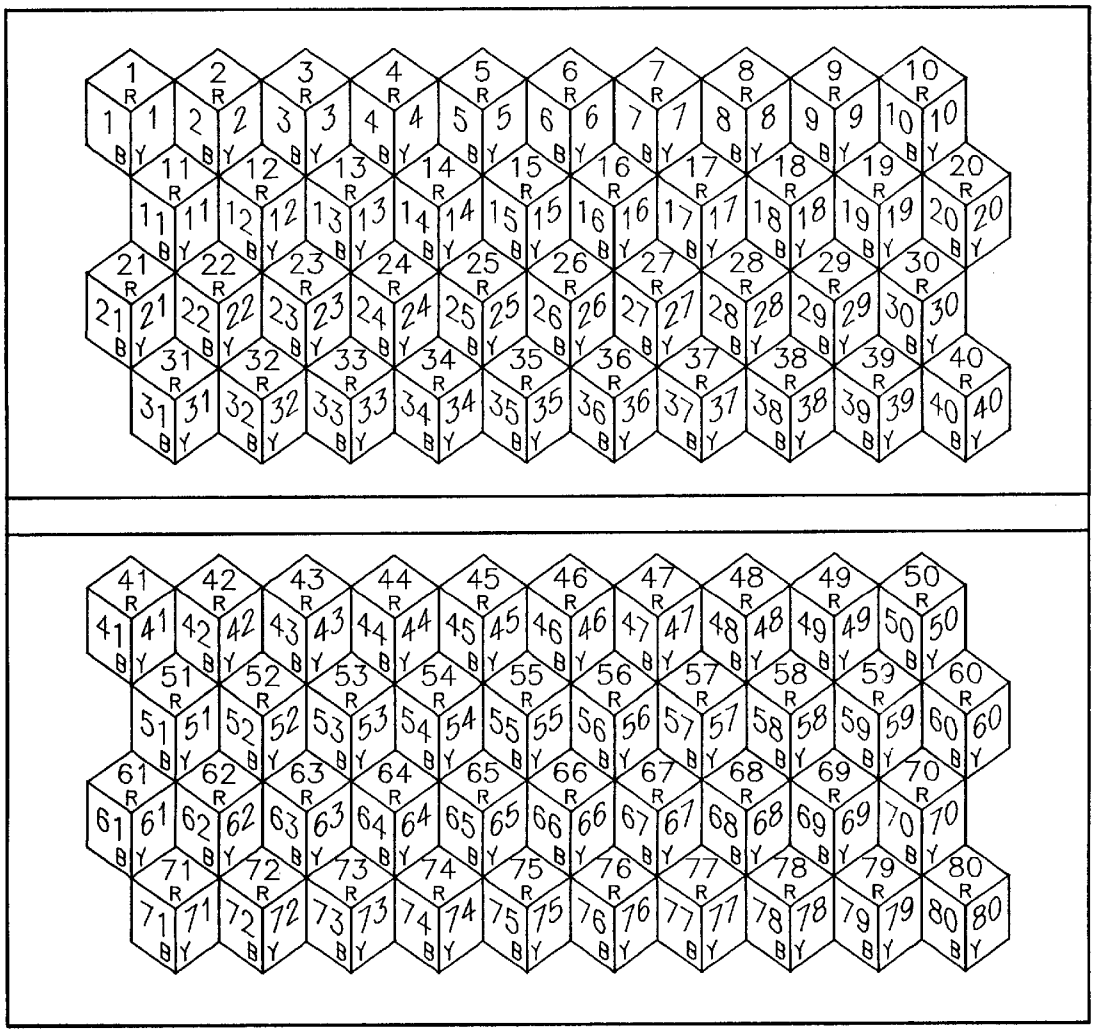
FIG. 1 shows a representative keno ticket display that can be used in the method of the present invention.

FIG. 1 shows a representative keno ticket on the screen display with each numbered spot divided into three sections. As shown in FIG. 1, each section is a square and the three sections are configured isometrically to appear as three faces of a cube. Any other suitable configuration can be used, such as a circle divided into three pie segments. If two sections or four or more sections are used, then a suitable configuration for each numbered spot is chosen.

With reference to each individual numbered spot, each section of the numbered spot has a unique demarcation to differentiate that section from the other sections of the numbered spot. One way to differentiate each section of the numbered spot is to use colors. As shown in FIG. 1, each numbered spot has an "R" ("red") section, a "B" ("blue") section and a "Y" ("yellow") section. Other indicia may be used to demarcate the sections from one another.

In the method of play using the keno ticket shown in FIG. 1, the player makes two or more wagers, preferably three. The player then selects from one to ten numbered spots as is traditional in electronic video keno games, although more numbered spots than ten may be selected if pay tables for more than ten numbered spots are provided. With regard to the preferred embodiment of three wagers, each of the three wagers are allocated to a particular color section of the numbered spots selected by the player. For example, if the player makes three $1 wagers and the player selects ten numbered spots; then $1 is allocated to the "red" section of the ten numbered spots, $1 is allocated to the "blue" section of the ten numbered spots and $1 is allocated to the "yellow" section of the ten numbered spots.

Figure 2:
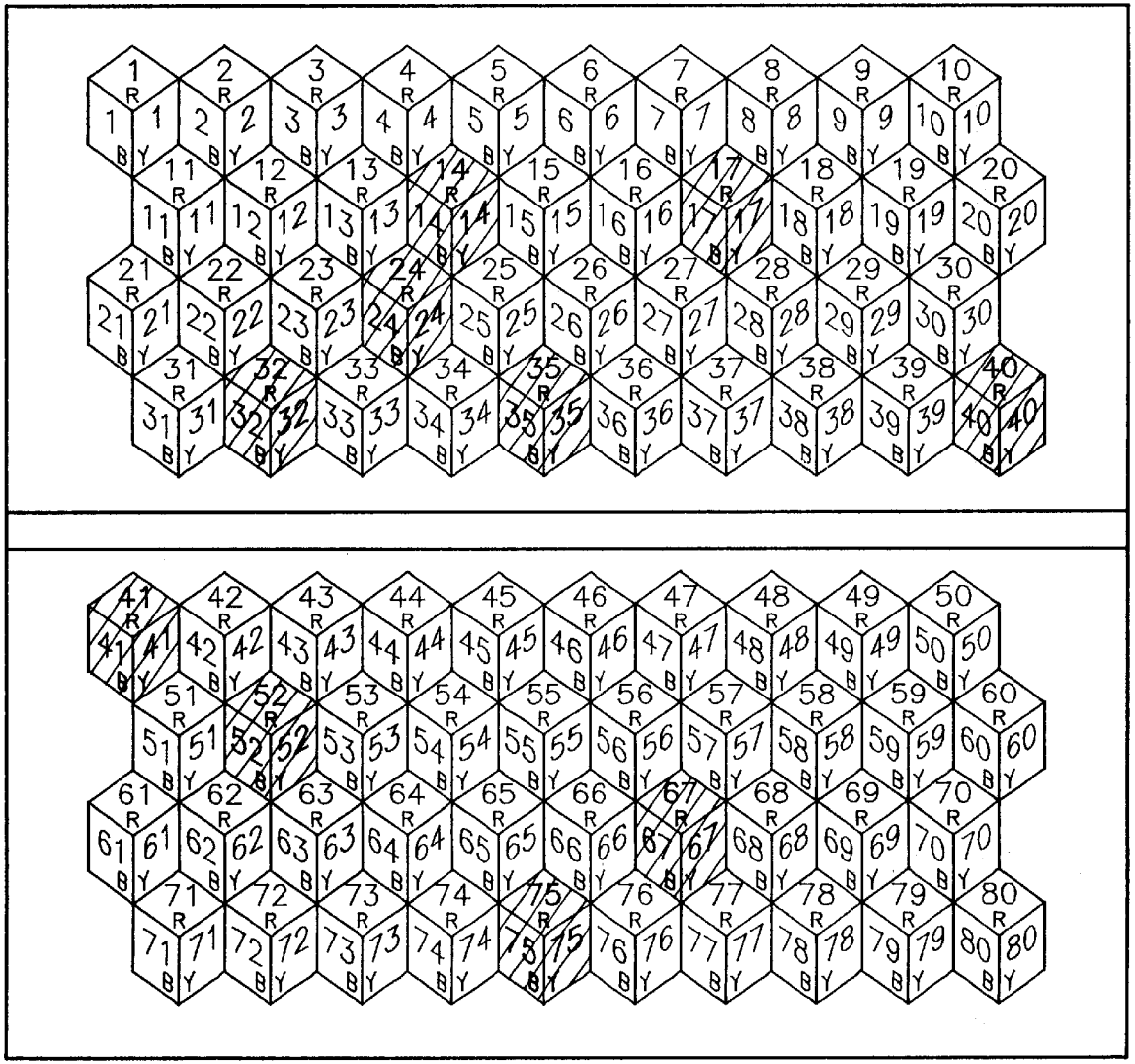
FIG. 2 shows the keno ticket display after the player has selected his ten numbered spots.

FIG. 2 shows the ten numbered spots that the player has selected for this round of the game. The numbered spots selected by the player are 14, 17, 24, 32, 35, 40, 41, 52, 67 and 75. All three section (the "red" section, the "blue" section and the "yellow" section) are active for the player in this round of the game. The numbered spots selected by the player can be indicated in any suitable manner on the keno ticket screen display, such as being highlighted.

Figure 3:
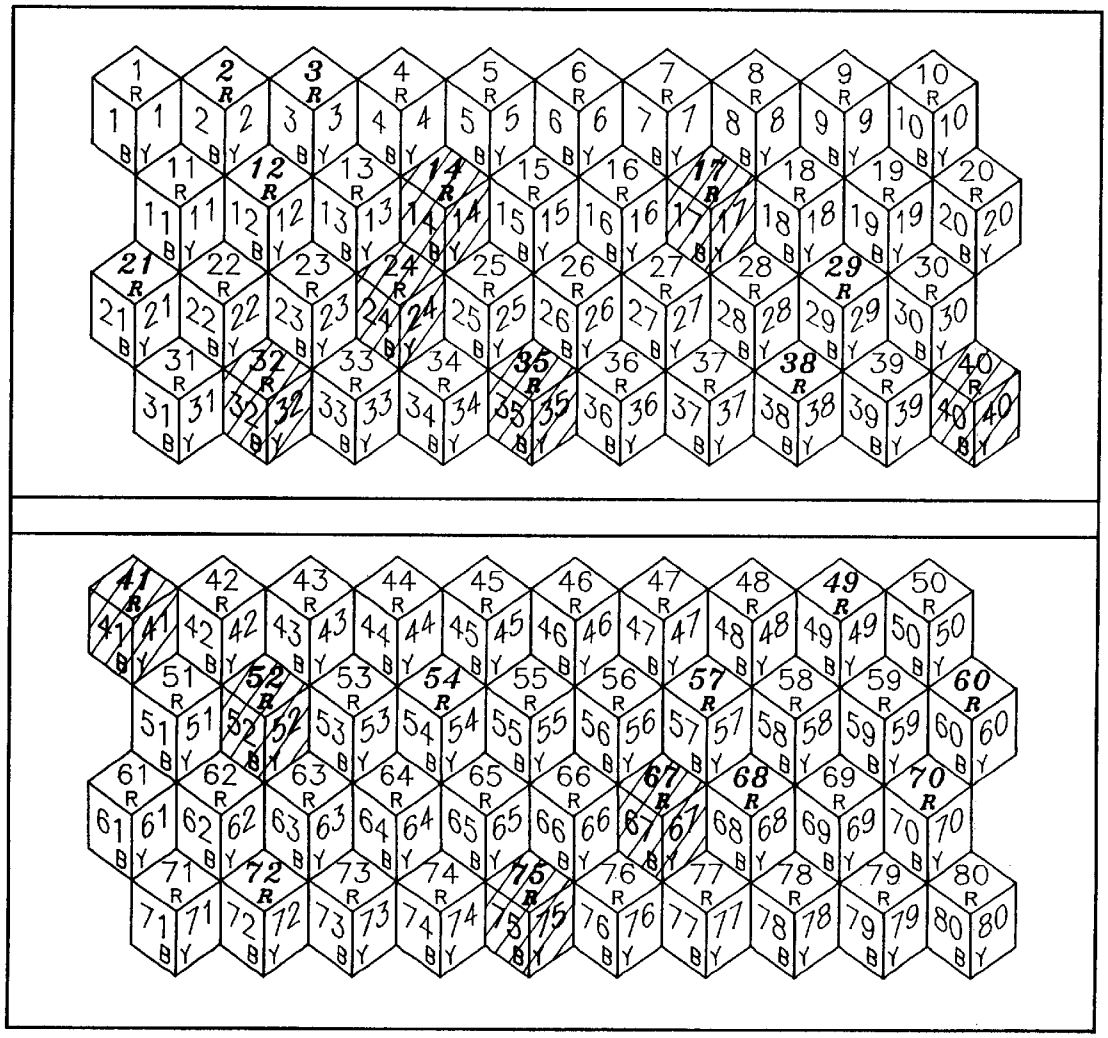
FIG. 3 shows the keno ticket display after the first group of twenty numbers, the "red" group, has been drawn.

After the player made his wager and has selected the numbered spots desired, the player presses the "Deal" or "Start" button on the electronic keno gaming machine to activate the play of the game. The computer controls randomly select a first group of twenty numbers from the complete pool of eighty numbers and these first twenty numbers are allocated to one of the sections of the keno ticket. For example, the first twenty numbers can be allocated to the "red" section of the keno ticket. As shown in FIG. 3, the twenty "red" numbers are 2, 3, 12, 14, 17, 21, 29, 35, 38, 41, 49, 52, 54, 57, 60, 67, 68, 70, 72 and 75. The numbers selected can be indicated in any suitable manner such as the italics shown in FIG. 3 or by highlighting the selected numbers.

Figure 4:
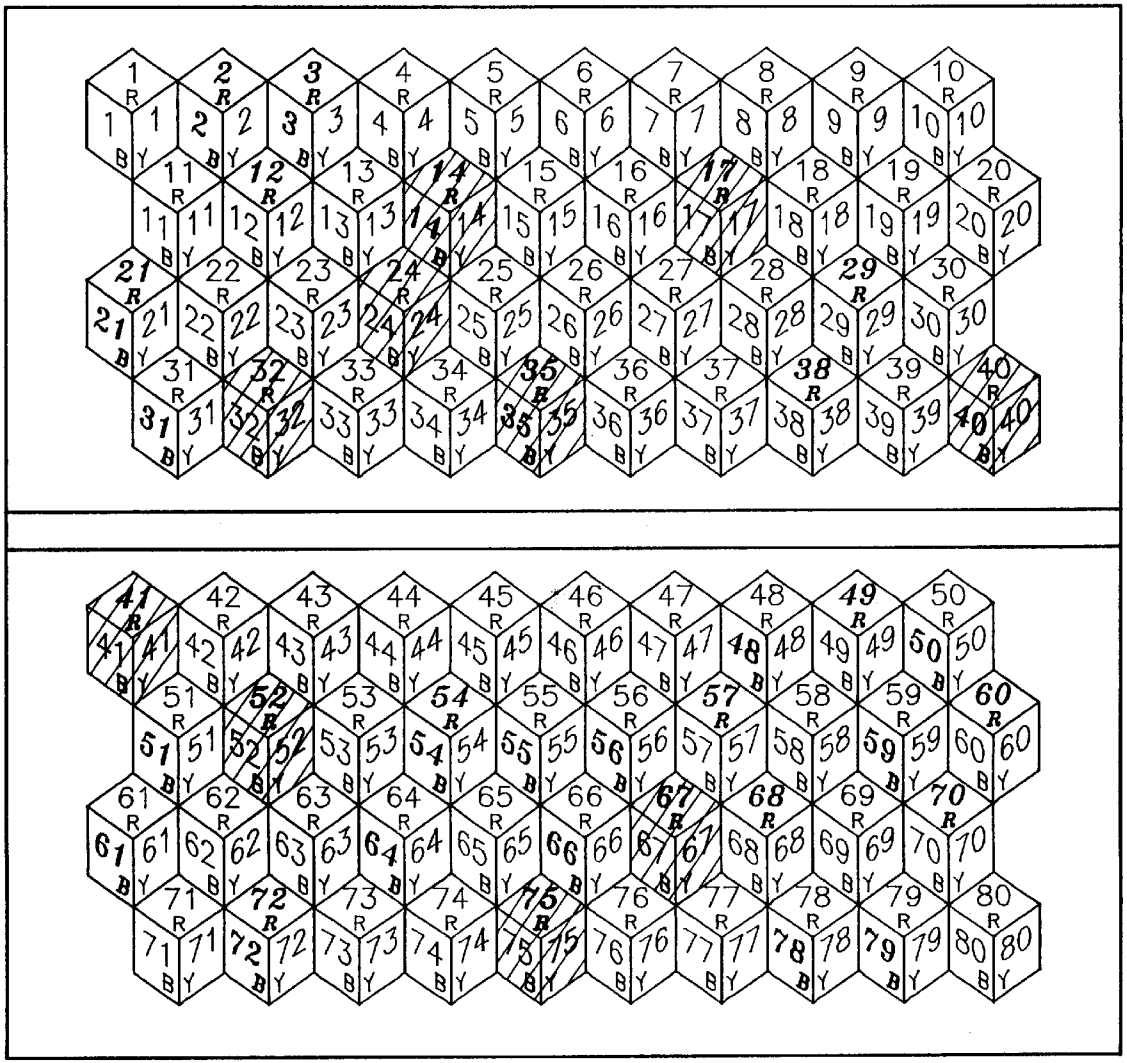
FIG. 4 shows the keno ticket display after the second group of twenty numbers, the "blue" group, has been drawn.

After the first twenty "red" numbers are drawn, the computer controls then randomly select a second group of twenty numbers from the complete pool of eighty numbers. These second twenty numbers are allocated to another section of the keno ticket, for example, the "blue" section of the keno ticket. As shown in FIG. 4, the twenty "blue" numbers are 2, 3, 14, 21, 31, 35, 40, 48, 50, 51, 54, 55, 56, 59, 61, 64, 66, 72, 78 and 79. The numbers selected can be indicated in any suitable manner such as the italics shown in FIG. 4 or by highlighting the selected numbers.

Figure 5:
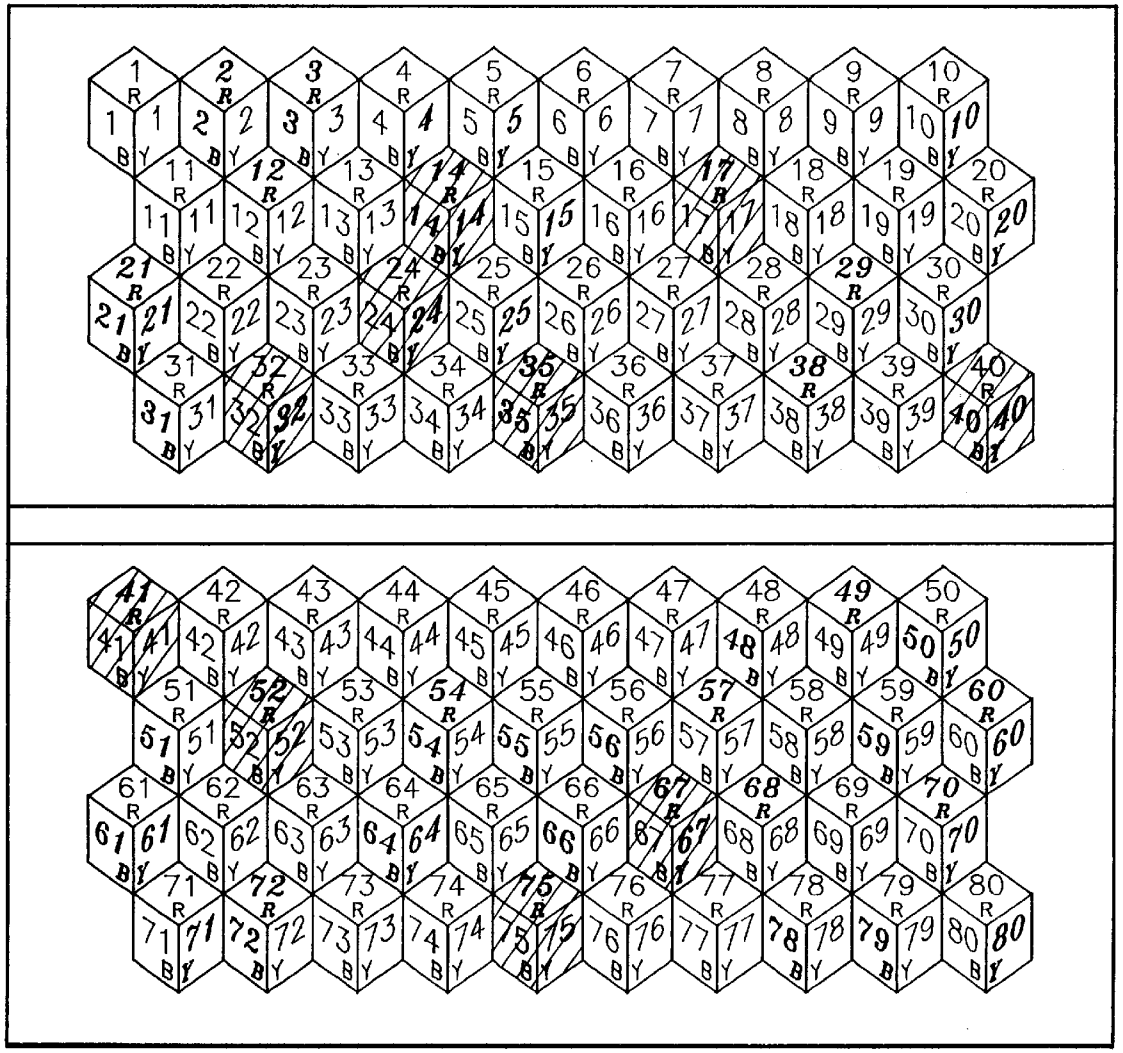
FIG. 5 shows the keno ticket display after the third group of twenty numbers, the "yellow" group, has been drawn.

Finally, the computer controls randomly select a third group of twenty numbers from the complete pool of eighty numbers. These third twenty numbers are allocated to the remaining section of the keno ticket, for example, the "yellow" section. As shown in FIG. 5, the twenty "yellow" numbers are 4, 5, 10, 14, 15, 20, 21, 24, 25, 30, 32, 40, 50, 60, 61, 64, 67, 70, 71 and 80. The numbers selected can be indicated in any suitable manner such as the italics shown in FIG. 5 or by highlighting the selected numbers.

The numbered spots selected by the player are then compared to the numbers randomly selected by the computer controls on a section-by-section basis. First the "red" group of twenty numbers are compared to the player's selected ten numbered spots to see how many matches or "Hits" the player has received. As shown in FIG. 3, the player has hit seven numbers which is a winning play when ten numbers are played. The payout earned by the player is shown in a payout table such as the one shown in Table 1. Using the payout table shown in Table 1, the player has won one hundred forty-two credits for each unit wagered by the player.

Next, the "blue" group of twenty numbers are compared to the player's selected ten numbered spots to see how many "Hits" the player has received. As shown in FIG. 4, the player has hit three numbers which is a losing play since the player must match at least five numbers, when ten numbers are played, to have a winning play.

Finally, the "yellow" group of twenty numbers are compared to the player's selected ten numbered spots to see how many "Hits" the player has received. As shown in FIG. 5, the player has hit five numbers which is also a winning play when ten numbers are played. The payout earned by the player is shown in a payout table such as the one shown in Table 1. Using the payout table shown in Table 1, the player has won five credits for each unit wagered by the player.

Table 1 shows a representative payout table for a keno game. The total numbered spots selected by the player is shown on the top while the number matched ("Hits") is shown on the left.

TABLE 1

| | NUMBER OF SPOTS SELECTED | | | | | | | | | |
|---|---|---|---|---|---|---|---|---|---|---|
| HITS | 1 | 2 | 3 | 4 | 5 | 6 | 7 | 8 | 9 | 10 |
| 1 | 3 | 0 | 0 | 0 | 0 | 0 | 0 | 0 | 0 | 0 |
| 2 | — | 15 | 2 | 2 | 0 | 0 | 0 | 0 | 0 | 0 |
| 3 | — | — | 46 | 5 | 3 | 3 | 1 | 0 | 0 | 0 |
| 4 | — | — | — | 91 | 12 | 4 | 2 | 2 | 1 | 0 |
| 5 | — | — | — | — | 810 | 70 | 26 | 12 | 6 | 5 |
| 6 | — | — | — | — | — | 1600 | 400 | 98 | 44 | 24 |
| 7 | — | — | — | — | — | — | 7000 | 1652 | 335 | 142 |
| 8 | — | — | — | — | — | — | — | 10000 | 4700 | 1000 |
| 9 | — | — | — | — | — | — | — | — | 10000 | 4700 |
| 10 | — | — | — | — | — | — | — | — | — | 12000 |

The payouts shown in Table 1 are for each coin, token or credit wagered and would be multiplied by the numbers of units wagered by the player. Most electronic keno gaming machines allow the player to wager from one to four coins, tokens or credits of whatever the denomination being used on the keno gaming machine.

Any suitable payout table can be used based on the mathematical odds which the gaming establishment wishes to offer to the player. For live keno games, the pay tables offered to the player also are based on the amount wagered by the player.

Besides paying off on each individual section game, the method of the present invention also allows payouts to be made to the player for achieving "Hits" on all three sections of the same numbered spot. For example, with reference to FIGS. 3–5, the only player selected numbered spot that was selected in all three groups of twenty numbers randomly chosen by the computer controls is numbered spot 14. Since the player hit all three sections of the numbered spot 14, the player can receive an additional payout. This payout for each of these three section "Hits" can be any suitable amount, say fifty units of the denomination being played by the player.

The method of the present invention can also be set to make an additional payout if the player hits two out of three sections on any numbered spot selected by the player. For example, again with reference to FIGS. 2–5, the player hit two out of three sections on the numbered spots 35, 40 and 67. This payout for each of these two out of three section "Hits" can be any suitable amount, say five units of the denomination being played by the player.

A variation of the present invention is shown in FIGS. 6–9. The player selects from one to ten numbered spots (again the method of the present invention can be configured to allow a player to select more than ten numbered spots if pay tables for more than ten numbered spots are provided), but by each color only. The player selects from one to ten numbered spots of the "red" section, from one to ten numbered spots of the "blue" section and from one to ten numbered spots of the "yellow" section. The player does not have to select the same amount of numbered spots in each section; the player can select from one to ten numbered spots in the "red" section, from one to ten numbered spots in the "blue" section and from one to ten numbered spots in the "yellow" section.

Figure 6:
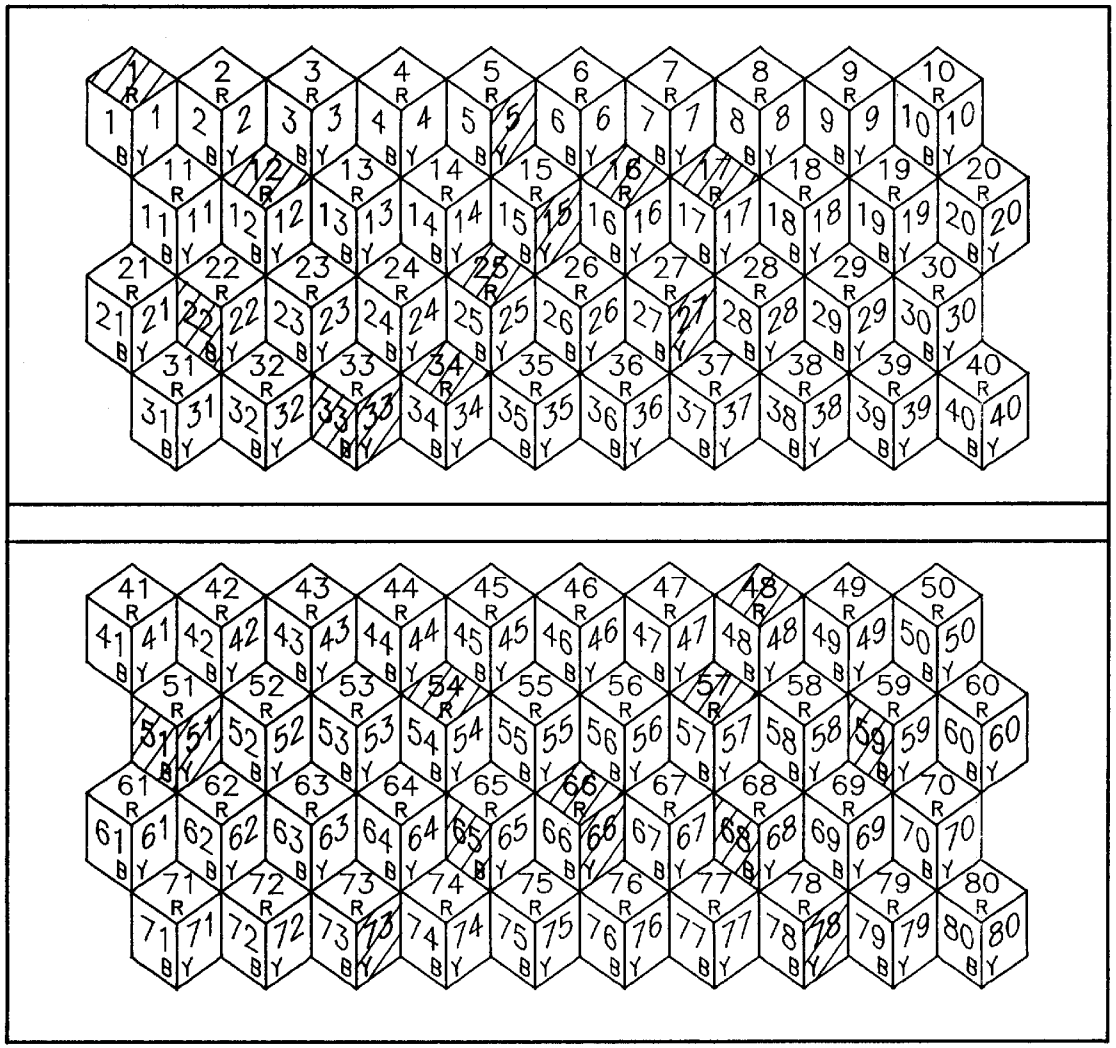
FIG. 6 shows a representative keno ticket display that can be used in an alternative method of the present invention after the player has selected his numbered spots.

As shown in FIG. 6, for example, the player has selected the ten numbered spots 1, 12, 16, 17, 25, 34, 48, 54, 57 and 66 in the "red" section; the six numbered spots 22, 33, 51, 59, 65 and 68 in the "blue" section; and the eight numbered spots 5, 15, 27, 33, 51, 66, 73 and 78 in the "yellow" section.

The player makes three wagers, one for each color, and presses the "Deal" or "Start" button to activate the keno gaming machine to select the numbers. The computer controls then randomly select a first group of twenty numbers from the complete pool of eighty numbers and these numbers are allocated to the "red" sections of the keno ticket. The player wins or loses based on the number of matches that the player has corresponding to the "red" section of each numbered spot on the keno ticket.

Figure 7:
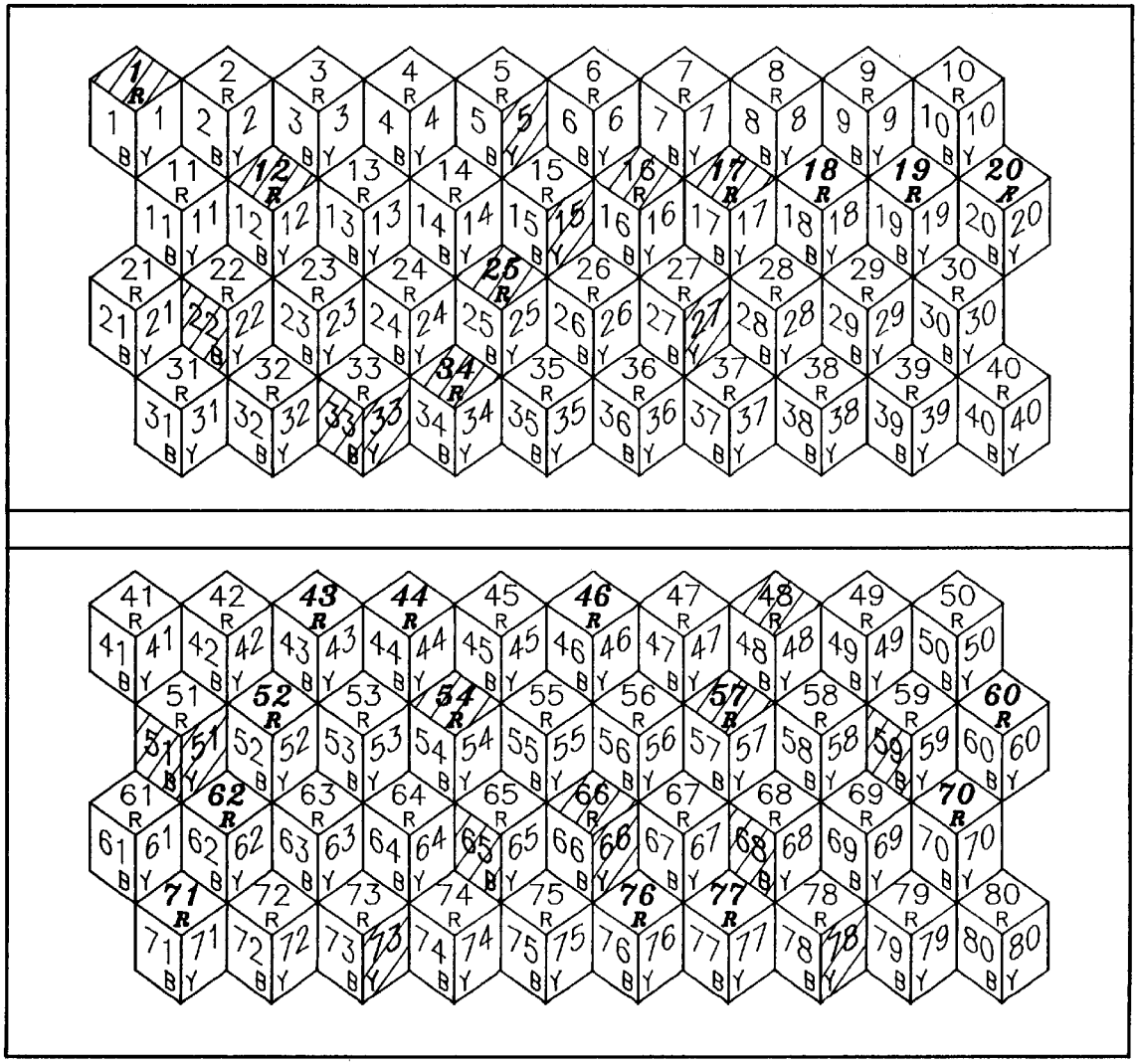
FIG. 7 shows the keno ticket display after the first group of twenty numbers, the "red" group, has been drawn for the alternative method of the present invention.

FIG. 7 shows the twenty "red" numbers that have been randomly selected which, for example, are 1, 12, 17, 18, 19, 20, 25, 34, 43, 44, 46, 52, 54, 57, 60, 62, 70, 71, 76 and 77. FIGS. 7 also shows that the player has hit on seven out of the ten numbered spots selected by the player. Using the payout table shown in Table 1, the player has won one hundred forty-two credits for each unit wagered by the player.

The computer controls then randomly select a second group of twenty numbers from the complete pool of eighty numbers and these numbers are allocated to the "blue" sections of the keno ticket. The player wins or loses based on the number of matches that the player has corresponding to the "blue" section of each numbered spot on the keno ticket.

Figure 8:
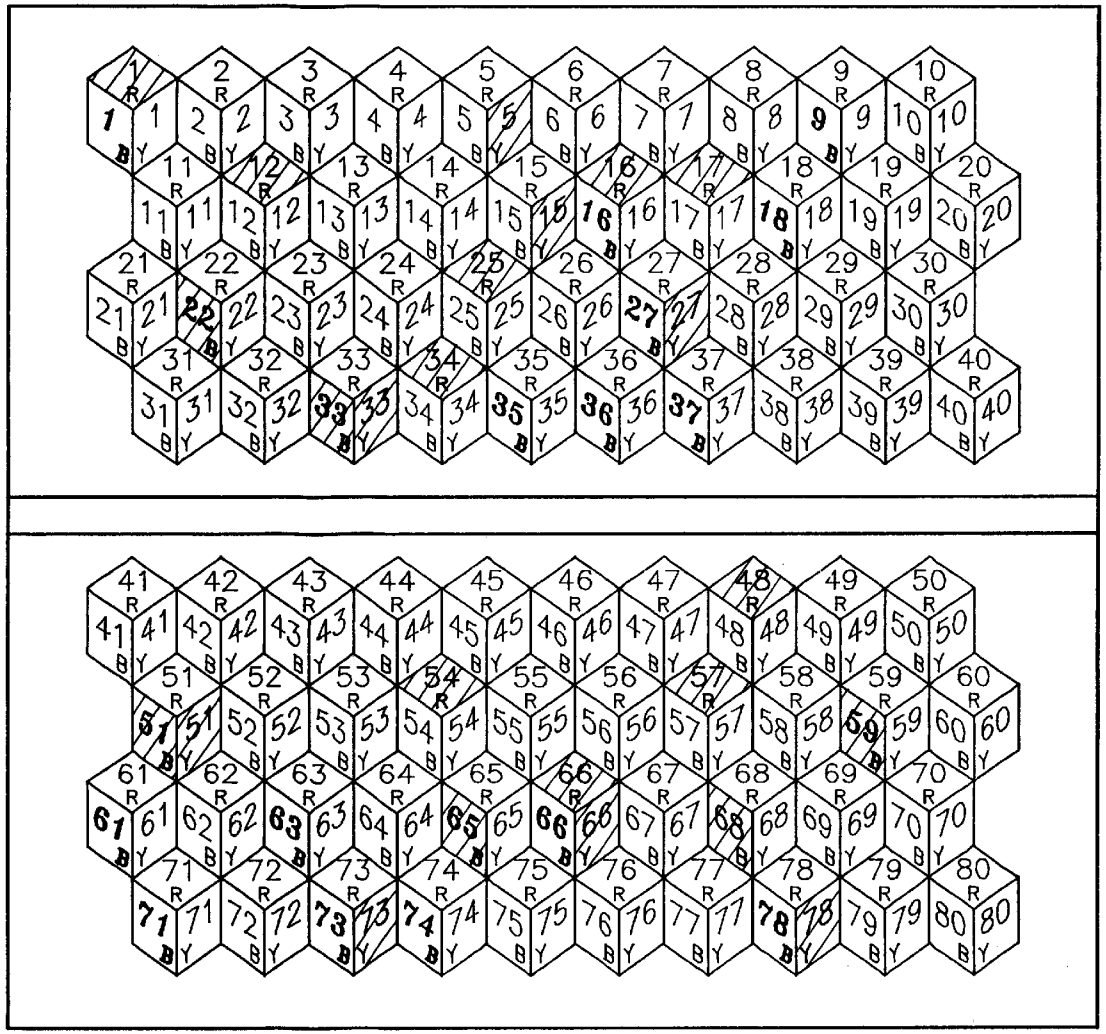
FIG. 8 shows the keno ticket display after the second group of twenty numbers, the "blue" group, has been drawn for the alternative method of the present invention.

FIG. 8 shows the twenty "blue" numbers that have been randomly selected which are, for example, 1, 9, 16, 18, 22, 27, 33, 35, 36, 37, 51, 59, 61, 63, 65, 66, 71, 73, 73 and 78. FIG. 8 also shows that the player has hit on five out of the six numbered spots selected by the player. Using the payout table shown in Table 1, the player has won seventy credits for each unit wagered by the player.

The computer controls then finally randomly select a third group of twenty numbers from the complete pool of eighty numbers and these numbers are allocated to the "yellow" sections of the keno ticket. The player wins or loses based on the number of matches that the player has corresponding to the "yellow" section of each numbered spot on the keno ticket.

Figure 9:
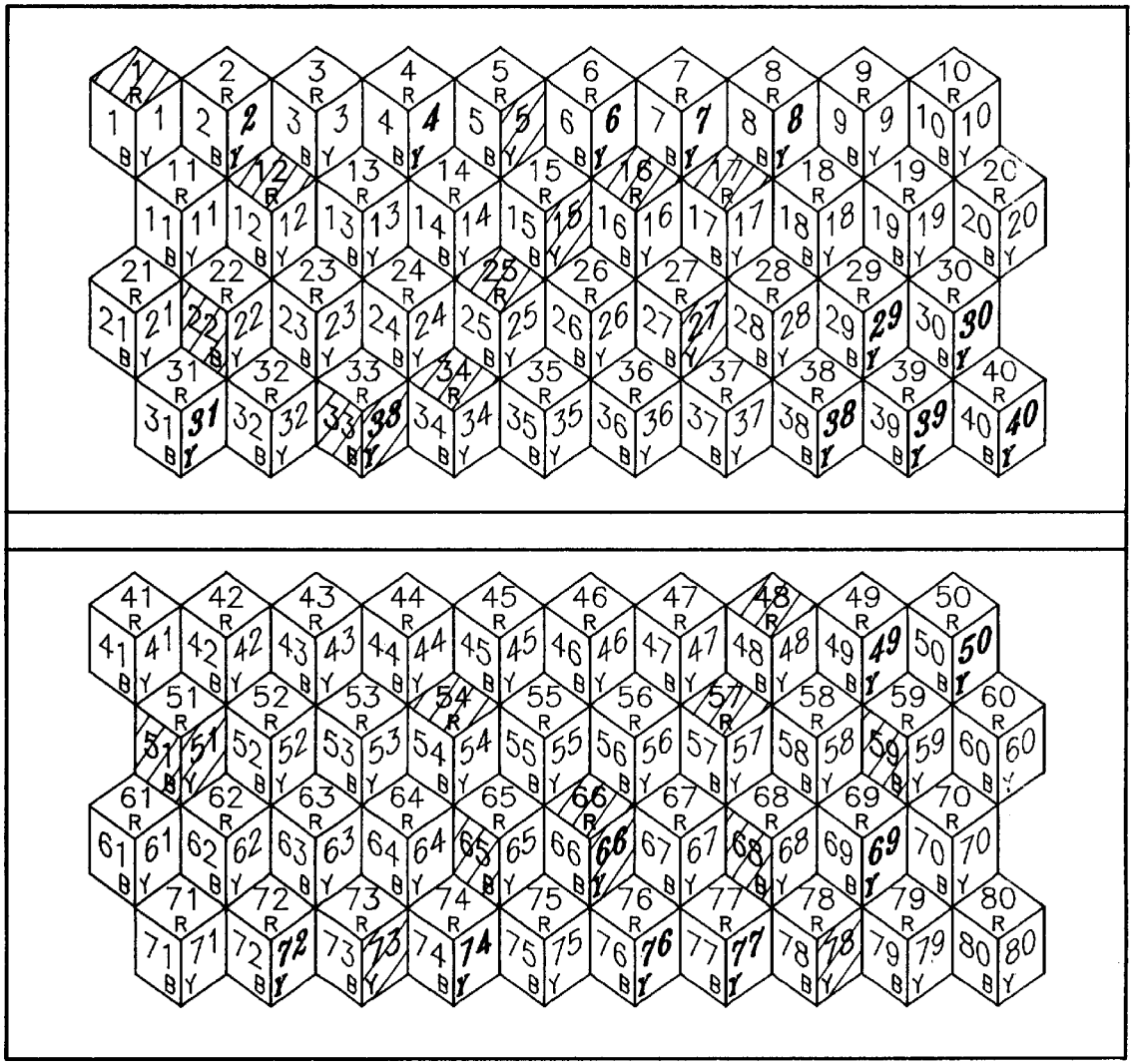
FIG. 9 shows the keno ticket display after the third group of twenty numbers, the "yellow" group, has been drawn for the alternative method of the present invention.

FIG. 9 shows the twenty "yellow" numbers that have been randomly selected which are, for example, 2, 4, 6, 7, 8, 29, 30, 31, 33, 38, 39, 40, 49, 50, 66, 69, 72, 74, 76 and 77. FIG. 8 also shows that the player has hit on only two out of the eight numbered spots selected by the player. Using the payout table shown in Table 1, the player has lost the units wagered by the player.

The method of the present invention can also be applied to a live keno game format. The keno ticket screen display shown in FIG. 1 can be adapted to a paper keno ticket so that each numbered spot is divided into two or more, and preferably three, sections. As described above in connection with the electronic keno game machine format, the player then selects the numbered spots he wishes to play for the "red" game, the "blue" game and the "yellow" game. After the player turns in his keno ticket and makes his wagers, the "red" game numbers, the "blue" game numbers and the "yellow" game numbers are drawn and winning and losing tickets are determined. The player can receive additional payouts for matching two or three sections of the same numbered spot in the course of multiple keno games.

The method of the present invention has been described in the context of the conventional keno format which uses a complete pool of eighty numbers, from which twenty numbers are drawn each game. However, the present invention can also be applied to keno games in which the size of the complete pool can be more or less than eighty numbers and which the amount of numbers drawn can be more less than twenty numbers. If the size of the complete pool is changed or the amount of numbers drawn is changed, then the payouts will also be changed to reflect the varying mathematical odds which are based on the size of the complete pool and the amount of numbers drawn.

While the invention has been described in the context of casino gaming, the principles of the present invention can also be applied to lottery games run by governmental agencies or other lottery game operators. These lottery games often use a keno-type format to determine winning outcomes of the lottery game. Lottery games typically use a smaller number pool than the eighty numbers used in the keno games offered in gaming casinos and it would be easy to adapt the method of the present invention to a typical lottery game. Any suitable percentages can be applied to the lottery variation of the present invention with the percentages being attained by the selection of the payouts made to the player.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A keno ticket comprising a plurality of numbered spots arranged in a matrix, with each numbered spot divided into at least two sections, each section being an isometric representation of a square.

2. The keno ticket of claim 1 in which a first section is designated by a first marking and a second section is designated by a second marking.

3. The keno ticket of claim 2 in which the first marking is a first color and the second marking is a second color.

4. The keno ticket of claim 1 wherein each numbered spot has three sections.

5. The keno ticket of claim 4 in which a first section is designated by a first marking, a second section is designated by a second marking and a third section is designated by a third marking.

6. The keno ticket of claim 5 in which the first marking is a first color, the second marking is a second color and the third marking is a third color.

7. The keno ticket of claim 1 in which the matrix has eighty numbered spots.

8. The keno ticket of claim 1 in which the numbered spots are displayed on paper.

9. The keno ticket of claim 1 in which the numbered spots are displayed on a video display screen.

10. A method of playing a keno game comprising:

a) providing a keno ticket comprising a plurality of numbered spots arranged on the keno ticket, with each numbered spot divided into at least two sections;

b) a player selecting a group of numbered spots on the keno ticket, each numbered spot selected by the player including all of the at least two sections;

c) randomly selecting from a first pool of numbers, a first plurality of numbers corresponding to the numbered spots;

d) randomly selecting from a second pool of numbers, a second plurality of numbers corresponding to the numbered spots;

e) determining how many matches have occurred between the numbered spots selected by the player and the first plurality of numbers; and f) determining how many matches have occurred between the numbered spots selected by the player and the second plurality of numbers.

11. The method of claim 10 further including:

a) the player making a first wager corresponding to the first section of the numbered spots selected by the player; and b) the player making a second wager corresponding to the second section of the numbered spots selected by the player.

12. The method of claim 11 further including:

a) paying the player based on the amount of the first wager and corresponding to a payout table if the player achieves at least a minimum numbers of matches between the first plurality of numbers and the numbered spots selected by the player; and b) paying the player based on the amount of the second wager and corresponding to a payout table if the player achieves at least a minimum numbers of matches between the second plurality of numbers and the numbered spots selected by the player.

13. The method of claim 11 further including:

a) determining how many matches have occurred between the numbered spots selected by the player, the first plurality of numbers and the second plurality of numbers; and b) paying the player a pre-established amount whenever there is a match among all of the numbered spots selected by the player, the first plurality of numbers and the second plurality of numbers.

14. The method of claim 10 further including determining how many matches have occurred between the numbered spots selected by the player, the first plurality of numbers and the second plurality of numbers.

15. A method of playing a keno game comprising:

a) providing a keno ticket comprising a plurality of numbered spots arranged on the keno ticket, with each numbered spot divided into three sections;

b) a player selecting a group of numbered spots on the keno ticket, each numbered spot selected by the player including all three sections;

c) randomly selecting from a first pool of numbers, a first plurality of numbers corresponding to the numbered spots;

d) randomly selecting from a second pool of numbers, a second plurality of numbers corresponding to the numbered spots;

e) randomly selecting from a first pool of numbers, a third plurality of numbers corresponding to the numbered spots;

f) determining how many matches have occurred between the numbered spots selected by the player and the first plurality of numbers;

g) determining how many matches have occurred between the numbered spots selected by the player and the second plurality of numbers; and h) determining how many matches have occurred between the numbered spots selected by the player and the third plurality of numbers.

16. The method of claim 15 further including:

a) the player making a first wager corresponding to the first section of the numbered spots selected by the player;

b) the player making a second wager corresponding to the second section of the numbered spots selected by the player; and c) the player making a third wager corresponding to the third section of the numbered spots selected by the player.

17. The method of claim 16 further including:

a) paying the player based on the amount of the first wager and corresponding to a payout table if the player achieves at least a minimum numbers of matches between the first plurality of numbers and the numbered spots selected by the player;

b) paying the player based on the amount of the second wager and corresponding to a payout table if the player achieves at least a minimum numbers of matches between the second plurality of numbers and the numbered spots selected by the player; and c) paying the player based on the amount of the third wager and corresponding to a payout table if the player achieves at least a minimum numbers of matches between the third plurality of numbers and the numbered spots selected by the player.

18. The method of claim 16 further including:

a) determining how many matches have occurred between the numbered spots selected by the player, the first plurality of numbers; the second plurality of numbers, and third plurality of numbers;

b) paying the player a first pre-established amount whenever there is a match among all of the numbered spots selected by the player, the first plurality of numbers, the second plurality of numbers and the third plurality of numbers;

c) paying the player a second pre-established amount whenever there is a match among all of the numbered spots selected by the player, the first plurality of numbers and the second plurality of numbers;

d) paying the player a third pre-established amount whenever there is a match among all of the numbered spots selected by the player, the first plurality of numbers and the third plurality of numbers; and e) paying the player a fourth pre-established amount whenever there is a match among all of the numbered spots selected by the player, the second plurality of numbers and the third plurality of numbers.

19. The method of claim 15 further including determining how many matches have occurred between the numbered spots selected by the player, the first plurality of numbers, the second plurality of numbers and the third plurality of numbers.

20. A method of playing a keno game comprising:

a) providing a keno ticket comprising a plurality of numbered spots arranged on the keno ticket, with each numbered spot divided into at least a first section and second section;

b) a player selecting a first group of numbered spots on the keno ticket, each numbered spot selected by the player including only the first section;

c) a player selecting a second group of numbered spots on the keno ticket, each numbered spot selected by the player including only the second section;

d) randomly selecting from a first pool of numbers, a first plurality of numbers corresponding to the numbered spots;

e) randomly selecting from a second pool of numbers, a second plurality of numbers corresponding to the numbered spots;

f) determining how many matches have occurred between the numbered spots in the first section selected by the player and the first plurality of numbers; and g) determining how many matches have occurred between the numbered spots in the second section selected by the player and the second plurality of numbers.

21. The method of claim 20 further including:

a) the player making a first wager corresponding to the first section of the numbered spots selected by the player; and b) the player making a second wager corresponding to the second section of the numbered spots selected by the player.

22. The method of claim 21 further including:

a) paying the player based on the amount of the first wager and corresponding to a payout table if the player achieves at least a minimum numbers of matches between the first plurality of numbers and the numbered spots selected by the player in the first section; and b) paying the player based on the amount of the second wager and corresponding to a payout table if the player achieves at least a minimum numbers of matches between the second plurality of numbers and the numbered spots selected by the player in the second section.

23. A method of playing a keno game comprising:

a) providing a keno ticket comprising a plurality of numbered spots arranged on the keno ticket, with each numbered spot divided into a first section, second section and a third section;

b) a player selecting a first group of numbered spots on the keno ticket, each numbered spot selected by the player including only the first section;

c) a player selecting a second group of numbered spots on the keno ticket, each numbered spot selected by the player including only the second section;

d) a player selecting a third group of numbered spots on the keno ticket, each numbered spot selected by the player including only the third section;

e) randomly selecting from a first pool of numbers, a first plurality of numbers corresponding to the numbered spots;

f) randomly selecting from a second pool of numbers, a second plurality of numbers corresponding to the numbered spots;

g) randomly selecting from a third pool of numbers, a third plurality of numbers corresponding to the numbered spots;

h) determining how many matches have occurred between the numbered spots in the first section selected by the player and the first plurality of numbers;

i) determining how many matches have occurred between the numbered spots in the second section selected by the player and the second plurality of numbers; and j) determining how many matches have occurred between the numbered spots in the third section selected by the player and the third plurality of numbers.

24. The method of claim 23 further including:

a) the player making a first wager corresponding to the first section of the numbered spots selected by the player;

b) the player making a second wager corresponding to the second section of the numbered spots selected by the player; and c) the player making a third wager corresponding to the third section of the numbered spots selected by the player.

25. The method of claim 24 further including:

a) paying the player based on the amount of the first wager and corresponding to a payout table if the player achieves at least a minimum numbers of matches between the first plurality of numbers and the numbered spots selected by the player in the first section;

b) paying the player based on the amount of the second wager and corresponding to a payout table if the player achieves at least a minimum numbers of matches between the second plurality of numbers and the numbered spots selected by the player in the second section; and c) paying the player based on the amount of the third wager and corresponding to a payout table if the player achieves at least a minimum numbers of matches between the third plurality of numbers and the numbered spots selected by the player in the third section.

* * * * *